US009254941B2

(12) United States Patent
Galownia et al.

(10) Patent No.: US 9,254,941 B2
(45) Date of Patent: Feb. 9, 2016

(54) RESEALABLE CONTAINER AND CLOSURE PACKAGE

(71) Applicant: BASF Corporation, Florham Park, NJ (US)

(72) Inventors: Joseph M. Galownia, New Albany, IN (US); David Munsterman, Shelbyville, KY (US); James B. Carroll, Jr., Cortlandt Manor, NY (US); Christopher J. Valovic, Tega Cay, SC (US); Daniel Malmgren, Charlotte, NC (US)

(73) Assignee: BASF Corporation, Florham Park, NJ (US)

( * ) Notice: Subject to any disclaimer, the term of this patent is extended or adjusted under 35 U.S.C. 154(b) by 43 days.

(21) Appl. No.: 14/224,589

(22) Filed: Mar. 25, 2014

(65) Prior Publication Data

US 2015/0274378 A1 Oct. 1, 2015

(51) Int. Cl.
*B65D 41/04* (2006.01)
*B65D 1/02* (2006.01)

(52) U.S. Cl.
CPC ..... *B65D 41/0414* (2013.01); *B65D 1/0246* (2013.01); *B65D 41/04* (2013.01)

(58) Field of Classification Search
CPC ..... B65D 41/0414; B65D 41/0435; B65D 41/0457; B65D 41/0464; B65D 41/04; B65D 1/0246; B65D 1/023; B65D 41/0471
USPC ..... 215/337, 329, 316, 44, 43; 220/293, 220/288, 289
See application file for complete search history.

(56) References Cited

U.S. PATENT DOCUMENTS

| | | | | |
|---|---|---|---|---|
| 3,480,170 | A * | 11/1969 | Gwilym et al. | 215/215 |
| 5,127,784 | A | 7/1992 | Eslinger | |
| 5,950,849 | A | 9/1999 | Ekkert et al. | |
| 6,942,114 | B2 | 9/2005 | Nishida | |
| 7,651,004 | B2 | 1/2010 | Fuchs | |
| 7,694,835 | B1 | 4/2010 | Montgomery | |

(Continued)

FOREIGN PATENT DOCUMENTS

| | | |
|---|---|---|
| JP | H10119997 | 5/1998 |
| WO | WO2009/115443 | 9/2009 |

OTHER PUBLICATIONS

"Standard Specification for Dimensions and Tolerances for Plastic Bottles", Designation: D2911-10, ASTM International, 2010, 16 pages.

(Continued)

*Primary Examiner* — Robert J Hicks
(74) *Attorney, Agent, or Firm* — Dierker & Associates, P.C.

(57) ABSTRACT

A resealable container and closure package includes a container and a closure cap. The container has a longitudinal center axis, and a finish. The finish includes an external thread, an annular lip, and a sealing surface. The external thread includes 1.5 turns of a complete thread having symmetrical flank angles of about 13 degrees. The lip extends radially inwardly from a neck at an angle from about 0 degrees to about 5 degrees from a plane orthogonal to the center axis. The sealing surface is on an exterior surface of the lip. The closure cap includes an end wall defining a circumferential edge, an annular skirt projecting from the end wall, and an internal thread defined on an inner surface of the annular skirt. The internal thread is threadingly engageable with the external thread. The internal thread has an "M" style cross section for an SP 400 Finish.

12 Claims, 5 Drawing Sheets

(56) References Cited

U.S. PATENT DOCUMENTS

| | | | |
|---|---|---|---|
| 7,735,664 | B1 | 6/2010 | Peters et al. |
| 8,002,133 | B2 | 8/2011 | Galownia et al. |
| 8,322,913 | B2 | 12/2012 | Galowina et al. |
| 2009/0188888 | A1 | 7/2009 | Penny |
| 2010/0140208 | A1 | 6/2010 | Parrinello et al. |

OTHER PUBLICATIONS

"Cap and Neck Finishes", SKS Bottle, accessed Nov. 15, 2013, 2 pages, http://www.sks-bottle.com/CapNeck.html.

"How do I know how to calculate a cap & neck size!", U.S. Plastic Corp Knowledgebase Article, 2003, 2 pages, http://www.usplastic.com/knowledgebase/article.aspx!contentkey=625.

* cited by examiner

RESEALABLE CONTAINER AND CLOSURE PACKAGE

BACKGROUND

Some dispersion-based colorants, such as universal colorants, are packaged in quart metal cans. The metal cans require a variety of tools to be opened in order to fill colorant dispensers. Such colorant dispensers are used to provide one or more colorants to a base paint to provide a paint of a desired color. A common method used to open the metal cans of universal, dispersion-based colorant is with the use of a carpet knife and a "church key" type triangular can opener. Both opening tools and methods of use leave small openings in the top of the can from which the colorant has to be poured. This results in slow addition time to the dispensers, does not allow the metal containers to fully empty, and does not allow for access to properly clean the containers for environmentally sound disposal.

In the daily filling of the colorant dispensers, a large number of quart containers are required. This process of refilling the dispensers requires a considerable time commitment. Typically, prior to filling the dispensers, the containers holding the colorant are shaken, such as in conventional paint mixing equipment, to mix and provide a uniform colorant. Examples of conventional paint mixing equipment clamp the container between top and the bottom plates and vigorously shake the container to mix the contents. In some cases, a tray shaker holds and mixes a plurality of containers simultaneously. Mixing in such equipment takes about 3-5 minutes. If a full quart of colorant is not used, the containers are stored until the next day. There is no way to reseal the partially filled open containers, subjecting the containers to potential contamination, spillage, evaporation of components, and inability to remix. Upon completion of filling all dispensing canisters, all the quart cans are disposed of as normal waste. There is no ability to recycle.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Some examples of the plastic containers of the present disclosure may be used for storing dispersion-based colorants, for example, universal colorants, generally containing over 10% pigment solids dispersed within a liquid vehicle, typically a mixture of surfactants, so as to maintain the pigment solids suspended in the liquid solution without separation. Examples of the containers of this disclosure are used to store and dispense the liquid colorants into paint dispensing machines which are used to make customized colors from a variety of paint bases. The containers of the present disclosure provide improvements in the daily filling of the colorant dispensers for paint formation, as previously described. Thus, ease of opening, being completely resealable, having rapid filling speeds, and being easily cleaned for disposal and being recyclable may be desirable properties of the containers of this disclosure. The plastic containers include a strengthening feature so that the container can withstand the forces extended on the container during the mixing or shaking required to provide colorant uniformity. Still further, the sealing and closure cap retention ability of the examples of the resealable container and closure package as disclosed herein is not diminished by the initial opening and subsequent resealing of the container and closure package.

Plastic container and closure packages that have a security portion of the annular skirt portion of the closure cap that engages the neck of the container have been tested. The testing has shown that the security portion prevents the cap from disengaging, thereby preventing the contents of the package from leaking out during a drop test. For example, a frangible security strip, or zip strip, must be removed before the existing closure cap can be unscrewed from the container. However, tests have shown that if the existing closure cap is reinstalled on the container, the sealed package leaks during the same drop test.

Leakage may be determined by placing a container filled with colored water on the side of the container on top of a piece of blotter paper. After a suitable period of time, for example 5 minutes, if no water is visibly observed, the container has not leaked. The ambient air pressure relative to the pressure in the container may range from zero gage pressure to ½ atmosphere (50.6 kilopascals) vacuum. The vacuum test is a more severe test that simulates the effect of changes in elevation that may increase a potential for leakage.

Figure 1:
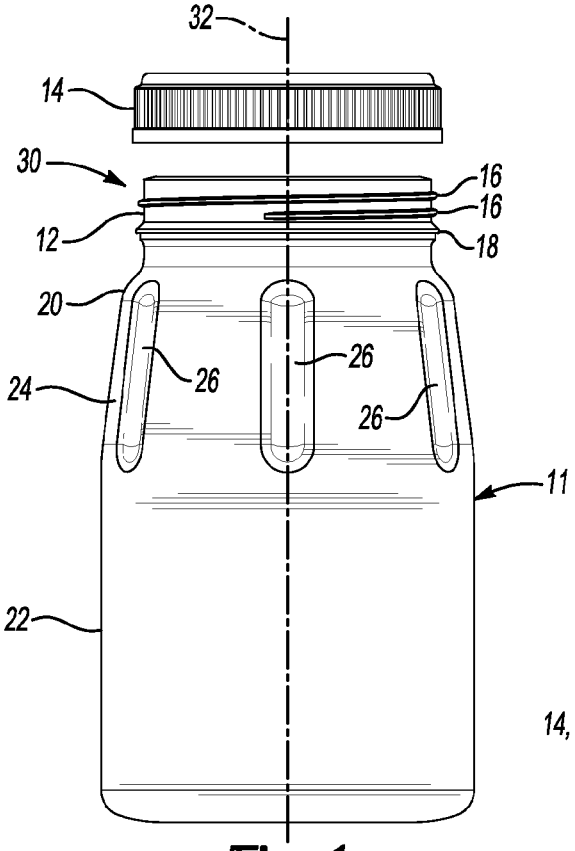
FIG. 1 is an exploded side view of an example of a resealable container and closure package according to the present disclosure.

ASTM International has published D2911-10, Standard Specification for Dimensions and Tolerances for Plastic Bottles. An example of a standard thread is an 89 SP 400 with an "M" style thread, as depicted in FIG. 1 of D2911-10.

Standard threads on the existing container combined with standard mating threads on the existing closure cap are not capable of undergoing the drop test leak-free without the security feature. Some existing container and closure cap combinations have deformable locking portions, or child-resistant tabs that must be deformed before the existing closure cap can be removed from the container.

In some cases, the existing closure caps are produced with interrupted threads that allow the caps to be ejected from the manufacturing molds without screwing the caps off of the mold. It is believed that the same mechanism that makes the caps ejectable from the mold, thereby lowering the cost of mass production, also allows the existing caps to leak during the drop test when tested without the security feature.

D2911-10 calls for a minimum of 1 full turn of thread for the SP 400 finish. In the present disclosure, a minimum of 1.5 full turns of thread are used. This 50 percent increase over the standard minimum allows stronger thread engagement when the cap is installed on the bottle.

In sharp contrast to the existing container/closure packages, examples of the present disclosure have strong threads that engage more turns of the closure cap of the present disclosure. The combination of the heretofore unknown neck finish, and closure cap with strong threads and resealable seals disclosed herein provides a resealable container and closure package that performs as well in the drop test after the closure cap has been removed and reinstalled as the container and closure package performs after the first installation of the closure cap. The combination of the improvements to the neck finish and closure cap with the plastic container may provide particular utility as a dispersion-based pigment container.

Figure 2:
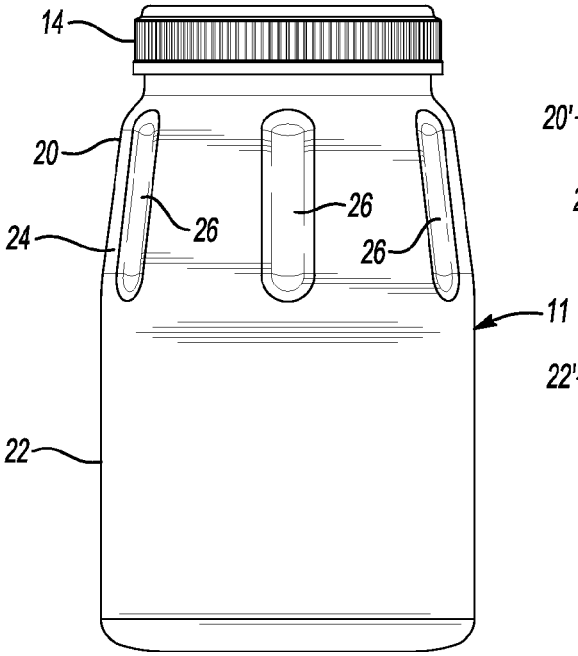
FIG. 2 is a side view of the example of the resealable container and closure package depicted in FIG. 1 with the closure cap installed on the container.
Figure 8:
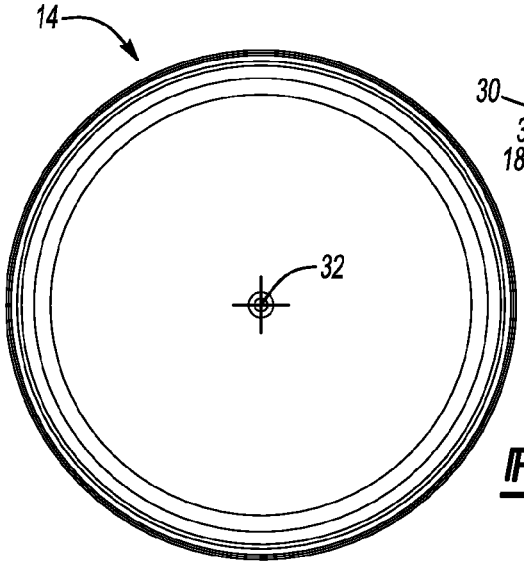
FIG. 8 is a plan view of an example of a closure cap according to the present disclosure.

An example of a resealable container and closure package of the present disclosure is shown in FIGS. 1 and 2 and is designated in general by reference numeral 10. The container, for example in quart (0.95 liter), 1.5 quart (1.42 liter), and one-half gallon (1.89 liter) sizes, may be formed by any method capable of forming the container 11. An example of a method capable of forming the container 11 is extrusion blow molding from high density polyethylene (HDPE). Examples of the container disclosed herein may be molded from other plastics including polypropylene (PP) or polyethylene terephthalate (PET). Referring to FIG. 1, the resealable container and closure package 10 includes the container 11 with a neck 12 which is of circular cross-section (see FIG. 8). The neck 12 has a wide mouth of a diameter of at least 50 mm. Diameters of at least 60 mm are also useful and, in particular, diameters of from 70-100 mm or more are contemplated. The neck 12 may be sealed by a closure cap 14 and be configured so as to allow the continuous opening and closing of the closure cap 14 onto the neck 12 to dispense and effectively seal the contents within the interior of container 11. Shown in FIG. 1 is a closure cap 14 in which spiral threads contained within the interior of closure cap 14 match with threads 16 on the neck 12. As shown, the neck 12 includes a raised annular neck bead 18.

Extending from the neck 12, container 11 includes a shoulder 20 which is of a greater diameter than neck 12. In examples, shoulder 20 may have a circular cross-section throughout. However, in other examples of the present disclosure, other cross-section shapes are possible, for example, elliptical, rectangular and square cross-sections are also disclosed herein. By maintaining a circular cross-section, it is believed the container of this disclosure may fit more readily into existing paint can handling equipment.

In the example depicted in FIG. 1, the shoulder 20 expands gradually from neck 12. Other examples of the shoulder may be provided as shown in the examples depicted in FIGS. 3 and 5. Below the shoulder 20 is the cylindrical body 22 of container 11. The body 22 has a uniform outer wall and may have a circular cross-section substantially throughout. Similarly to the shoulder 20, the body 22 may be provided with other than a circular cross-section.

A hand grip portion of the container 11, indicated by reference numeral 24, includes a plurality of circumferentially-spaced ribs 26, which increase the strength of the plastic container 11 and allow the container 11 to be used in the conventional paint mixing equipment, and still maintain the integrity of the container 11 during the vigorous shaking in such equipment. The ribs 26, as shown in FIG. 1, are indentions that extend toward the interior of the container 11. It is to be understood that the ribs 26 may be in the form of the indentions as shown in FIG. 1, or protrusions from the outer surface as shown by ribs 26' in FIG. 3.

The container 11 does not contain any handle accessory which needs to be separately molded or separately formed and subsequently added to the container 11. Further, the container 11 of the present disclosure does not include any handle configuration that extends or protrudes laterally from the container 11. Thus, the mold for container 11 is of relatively simple construction and allows for relatively easy molding with a uniform thickness easy to obtain.

Figure 3:
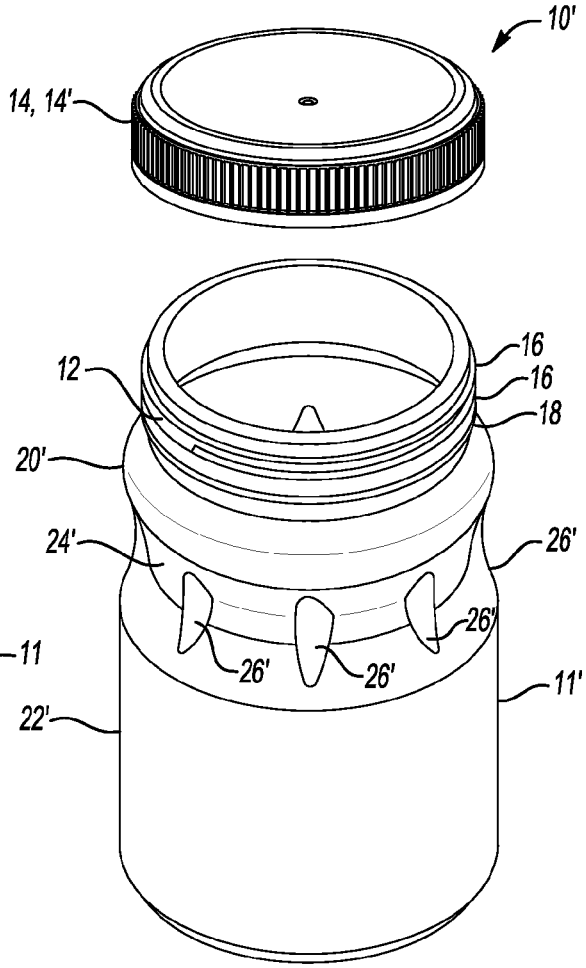
FIG. 3 is an exploded perspective view of another example of a resealable container and closure package according to the present disclosure.
Figure 4:
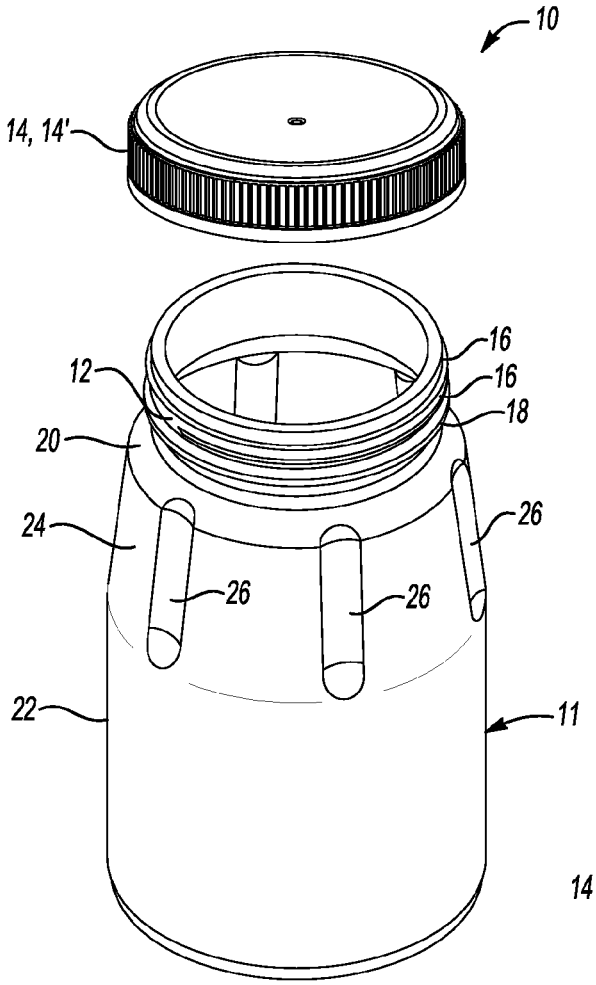
FIG. 4 is an exploded perspective view of the example of the resealable container and closure package depicted in FIG. 1.

FIG. 3 is an exploded perspective view of another example of a resealable container and closure package 10' according to the present disclosure. The plastic container 11' shown in FIG. 3 may, for example, be produced in quart (0.95 liter), 1.5 quart (1.42 liter), and one-half gallon (1.89 liter) sizes. The container 11' may be formed by extrusion blow molding from the plastic materials as used to form container 11 described above. Container 11' includes a neck 12, which is of a circular cross-section (see FIG. 8). The neck 12 depicted in FIG. 4 is identical to the neck 12 depicted in FIG. 1. As such, the neck 12 may be sealed by the closure cap 14, which is also identical to the closure cap 14 depicted in FIG. 1 and can be configured so as to allow the continuous opening and closing of the closure cap 14 onto the neck 12 to dispense and effectively seal the contents within the interior of container 11'. As depicted in FIG. 3, the neck 12 contains spiral threads 16, which match the threads contained in the interior of the closure cap 14. The neck 12 also includes a raised annular neck bead 18, identical to the raised annular neck bead 18 depicted in FIG. 1.

Below the neck 12, the container 11' includes a shoulder 20' that is of a greater diameter than neck 12. The shoulder 20' preferably has a circular cross-section throughout. A particular difference between container 11' and container 11 of FIG. 1 is the shape of the shoulder 20'. Thus, the shoulder 20' is of a rounded shape that ultimately blends with a hand grip portion 24' that has a diameter smaller than the shoulder 20' as compared to shoulder 20 of container 11, which expands from the neck to the hand grip portion 24 which continues to expand to blend with the body portion 22.

The circumferential hand grip portion 24' is positioned between shoulder 20' and body 22' in the form of a circumferential indention around container 11'. The grip portion 24' has an outside diameter less than both the outside diameters of shoulder 20' and body 22', and allows the user to hold the container 11' within one hand, typically between a thumb and forefinger of the hand. Like the container 11 depicted in FIG. 1, the container 11' depicted in FIG. 3 does not include a handle accessory which needs to be separately molded or separately formed and subsequently added to the container 11'. Further, the container 11' of the present disclosure does not include any handle configuration that extends or protrudes laterally from the container 11'. Thus, the mold for container 11' is of relatively simple construction and allows for relatively easy molding with a uniform thickness easy to obtain. The narrow diameter grip portion 24' maintains the circular cross-section of the container 11' of this disclosure from top to bottom, and allows the container 11' of this disclosure to be utilized in conventional paint can handling and shaking equipment.

In part to strengthen container 11', the grip portion 24' contains a plurality of vertical ribs 26' circumferentially spaced along and molded into the grip portion 24'. The ribs 26' may be protrusions from the outer surface as shown in FIG. 3, or may be indentions as shown in the container 11, 11" illustrated in FIGS. 1 and 5, respectively. The ribs 26' reinforce the strength of container 11' and, in particular, provide strength to withstand the vigorous shaking which takes place in conventional paint mixing equipment.

Below the shoulder 20' is a cylindrical body 22' of container 11'. The body 22' has a uniform outer wall and a circular cross-section substantially throughout. The body 22' may be provided with other than a circular cross-section.

FIG. 4 is an exploded perspective view of the example of the resealable container and closure package 10 depicted in FIG. 1.

Figure 5:
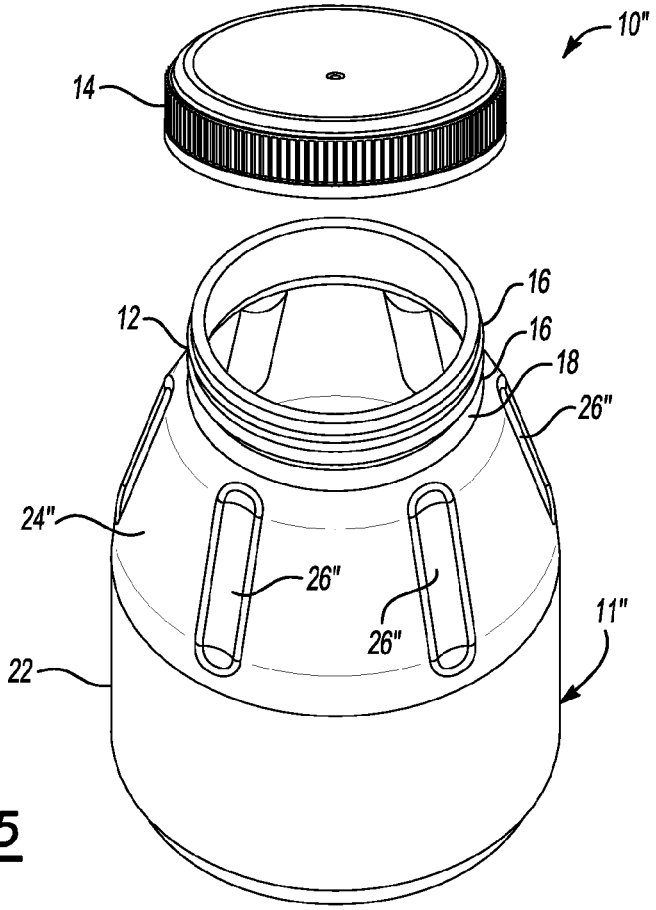
FIG. 5 is an exploded perspective view of a further example of a resealable container and closure package according to the present disclosure.

FIG. 5 is an exploded perspective view of a further example of a resealable container and closure package 10" according to the present disclosure. In FIG. 5 is shown still another example of the plastic container 11" of the present disclosure. The plastic container 11" may be formed of the same plastic materials as the containers 11, and 11'. Again, container 11" may be formed by any suitable molding technique. The neck 12 depicted in FIG. 5 is identical to the neck 12 depicted in FIG. 1. As such, the neck 12 may be sealed by the closure cap 14, which is also identical to the closure cap 14 depicted in FIG. 1 and may allow the continuous opening and closing of the closure cap 14 onto the neck 12 to dispense and effectively seal the contents within the interior of container 11". As depicted in FIG. 5, the neck 12 includes spiral threads 16, which match the threads formed on the interior of the closure cap 14. The neck 12 also includes a raised annular neck bead 18, identical to the raised annular neck bead depicted in FIG. 1.

The hand grip portion 24" of container 11" depicted in FIG. 5 is not formed by a circumferential indented ring, as in container 11' depicted in FIG. 3. However, the hand grip portion 24" of container 11" contains a plurality of circumferentially-spaced ribs 26", which increase the strength of the plastic container 11" and allow the container 11" to be used in the existing paint mixing equipment, and still maintain the integrity of the container 11" during the vigorous shaking in such equipment. The ribs 26", as shown in FIG. 5, are indentions, or in other words, extend toward the interior of the container 11". It is to be understood that the ribs 26" may be in the form of the indentions as shown in FIG. 1, or protrusions from the outer surface as shown by ribs 26' in FIG. 3.

Below the hand grip portion 24" is a body portion 22". The body portion 22" may have a uniform outer wall and a circular cross-section substantially throughout. Likewise, the hand grip portion 24" and the neck 12 may have circular cross-sections. The hand grip portion 24" of container 11" may expand from neck 12 to the body portion 22".

Figure 6:
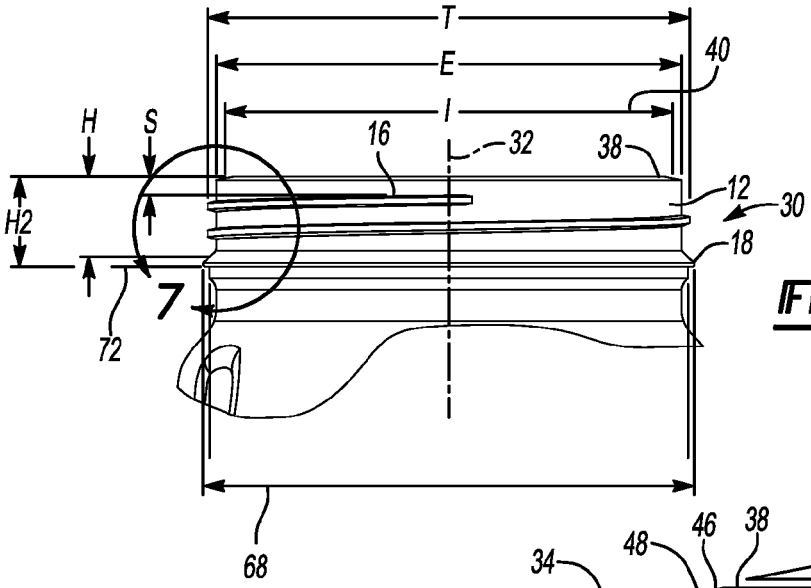
FIG. 6 is a side view of a neck finish portion of an example of a container of the present disclosure.
Figure 7:
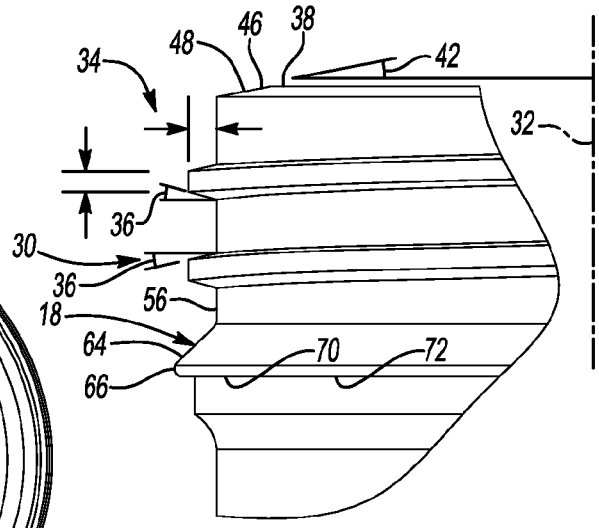
FIG. 7 is an enlarged side view depicting thread profile detail of the neck finish portion of the example shown in FIG. 6.

FIG. 6 is a side view of a neck finish portion 30 of an example of a container 11, 11', 11" of the present disclosure. FIG. 7 is an enlarged side view depicting thread profile detail of the neck finish portion of the example shown in FIG. 6. The resealable container and closure package 10, 10', 10" (FIGS. 1, 3 and 5) includes the container 11, 11', 11" and a closure cap 14, 14'. The container 11, 11', 11" includes a longitudinal center axis 32 and a finish portion 30 formed on the neck 12 of the container 11, 11', 11". The finish portion 30 includes a single start external helical thread formation 16 established on the finish portion 30. The external thread formation 16 includes about one and one-half continuous thread turns of a complete thread profile 34. The complete thread profile 34 has symmetrical external thread flank angles 36 of about 13 degrees.

As used herein, the term flank angle means an angle between an individual flank and the perpendicular to the center axis 32 measured in the axial plane. As used herein, the term flank means either surface connecting the crest with the root of the thread. As used herein, the term crest means the surface of the thread that joins the flanks of the thread and is farthest from the cylinder from which the thread projects. The crest of an external thread is at the major diameter of the external thread, while the crest of an internal thread is at the minor diameter of the internal thread. As used herein, the term root means the surface that joins the flanks of two adjacent threads. As used herein, a complete thread profile 34 is a thread profile having full form at the crest and the root. The complete thread profile 34 is substantially constant along the thread. A complete profile does not include a lead-in portion. A thread may have lead-in portions in which the thread profile gradually changes from a no thread (i.e., an unthreaded portion of a threaded object) to the fully-developed thread. Such a lead-in portion of a thread may make it easier to align the thread with a mating thread on a mating part.

Still referring to FIGS. 6 and 7, the finish portion 30 further includes a resilient annular lip 38 extending radially inwardly from an inner diameter 40 of the neck 12 at an angle 42 from about 0 degrees to about 5 degrees from a plane 44 orthogonal to the center axis 32. The finish portion 30 still further includes a sealing surface 46 disposed on an exterior surface 48 of the resilient annular lip 38.

A raised annular neck bead 18 is disposed on an outer surface 56 of the neck 12 distal to the annular lip 38. A frustoconical surface 64 of the raised annular neck bead 18 increases in diameter as a distance from the annular lip 38 increases. A cylindrical surface 66 of the raised annular neck bead 18 is defined at a maximum diameter 68 of the frustoconical surface 64. An edge 70 of the cylindrical surface 66 distal to annular lip 38 defines a finish bottom plane 72 perpendicular to the longitudinal center axis 32.

The external thread formation 16 has a major diameter T from 88.73 (mm) millimeters to 89.63 mm. The external thread formation 16 has a minor diameter E from 85.68 mm to 86.58 mm. The neck 12 has a minimum internal diameter I of 73.66 mm.

A top edge 92 of the annular lip 38 is distal to an enclosed volume 94 of the resealable container and closure package 10, 10', 10". The top edge 92 of the annular lip 38 defines an inner lip diameter 96 that is 7.62 mm smaller than the minor diameter E. A shortest distance S between the top edge 92 of the annular lip 38 and the external thread formation 16 is from 3.23 mm to 3.99 mm. A shortest distance H between the top edge 92 of the annular lip 38 and the frustoconical surface 64 of the raised annular neck bead 18 measured at an intersection of the frustoconical surface 64 and a circular cylinder coaxial with the longitudinal center axis 32 with a diameter from 87.89 mm to 88.39 mm is from 15.06 mm to 15.82 mm. The maximum diameter 68 of the frustoconical surface is from 89.92 mm to 90.42 mm. A perpendicular distance H2 between the top edge 92 of the annular lip 38 and the finish bottom plane 72 is from 16.32 mm to 17.08 mm.

The package 10, 10', 10" further includes a closure cap 14, 14'. FIGS. 8-12 depict an example of a closure cap 14 according to the present disclosure. In examples of the present disclosure, the closure cap 14 may be molded from an impact resistant copolymer. An example of an impact resistant copolymer of the present disclosure is Pinnacle PP 3220 Polypropylene Impact Copolymer (available from Pinnacle Polymers, Garyville, La.) with 1 percent Kemamide® E (available from Chemtura Corp., headquarters in Philadelphia, Pa.) It is believed that the impact resistant copolymer contributes to the superior drop test performance of the resealable container and closure package of the present disclosure. The closure cap 14 includes an end wall 50 defining a circumferential edge 52. The closure cap 14 has an annular skirt 54 projecting from the end wall 50. A raised annular cap bead 74 is disposed on the closure cap 14 to sealingly engage the sealing surface 46 when the closure cap 14 is installed on the container 11, 11', 11". An internal thread 60 is defined on an inner surface 62 of the annular skirt 54. The internal thread 60 is threadingly engageable with the external thread formation 16 (see FIG. 13). The internal thread 60 has an "M" style cross-section for an SP 400 Finish (see ASTM D2911-10). It is to be understood, however, that even though the "M" style cross-section that would mate with an SP 400 Finish is used, the container of the present disclosure does not have an SP 400 finish. Further, the cap is not a standard cap, since the standard caps are selected to mate with standard finishes.

Figure 9:
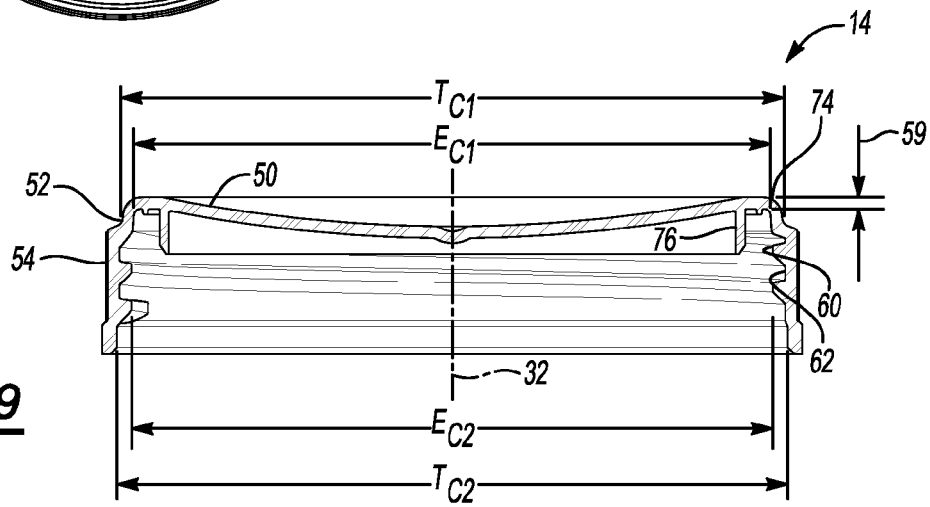
FIG. 9 is a side cross-sectional view of the example of the closure cap depicted in FIG. 8.

The use of standard neck finishes and caps is compelling in the industry. Typically, a standard neck finish is chosen, and a standard cap is selected to match the chosen neck finish. Developing a non-standard closure requires iteratively designing and creating tooling, then testing the container/cap. There is strong competition on price in the container market, therefore it has been considered prohibitively expensive to stray from standard parts. Nonetheless, the inventors of the present disclosure endeavored to create a closure and neck finish with characteristics that are superior to any existing closure and neck finish for a plastic container. As shown in FIG. 9, the outer diameter $T_{C1}$ of the circumferential edge 52 is 89.20 mm. The annular skirt 54 has an interior wall diameter $E_{C1}$ of 85.98 mm opposite the circumferential edge 52. The internal thread 60 has a minor diameter $E_{C2}$ of 86.11 mm. The internal thread 60 has a major diameter $T_{C2}$ of 89.38 mm. The thickness 59 of the end wall is 1.6 mm.

In examples of the present disclosure depicted in FIGS. 8-12, an annular plug seal 76 may extend substantially parallel to the center axis 32 from the end wall 50. The annular plug seal 76 may have an unstressed plug seal outer diameter 78 of 78.49 mm which is about 0.19 inch (4.83 mm) larger than the inner diameter 40 of the neck 12. The annular plug seal 76 may have an outer filet or chamfer 80 at a leading edge 82 of the annular plug seal 76. The annular plug seal 76 may sealingly engage the annular lip 38 and form an interference fit with the annular lip 38 when the closure cap 14 is installed on the container 11, 11', 11". (see FIG. 13)

Figure 10:
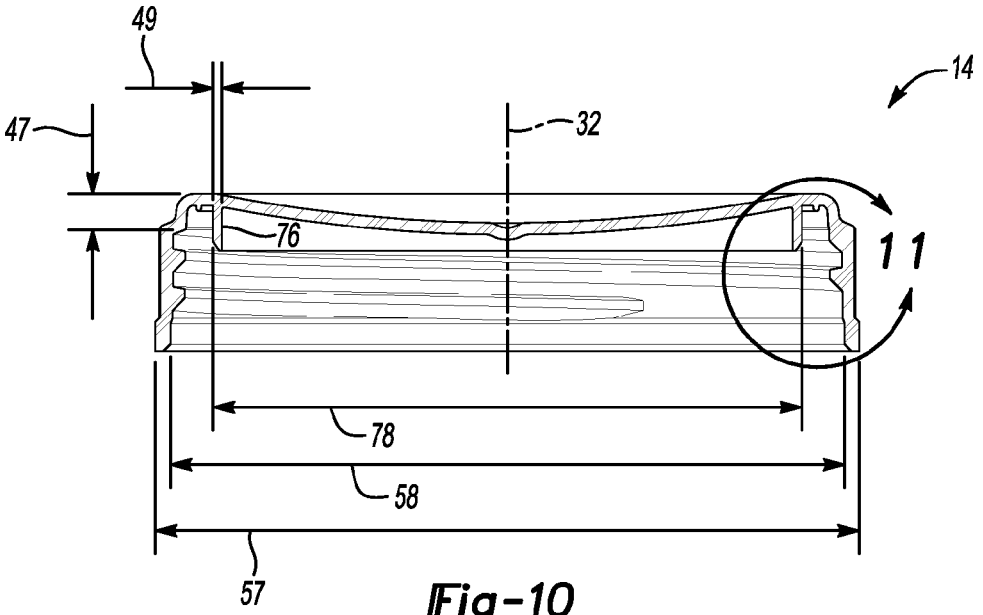
FIG. 10 is another side cross-sectional view of the example of the closure cap depicted in FIG. 8.

FIG. 10 depicts further dimensions of the closure cap 14 with the annular plug seal 76. Below the threaded portion of the closure cap 14, the annular skirt 54 has a flared portion 55 with an outside diameter 57 of about 93.98 mm and an internal diameter 58 of about 89.99 mm. The closure cap 14 defines a top plane 45 at a greatest distance parallel to the center axis 32 from the annular skirt 54. To illustrate, if the closure cap 14 were to be placed with the end wall 50 resting on a table surface (not shown), the table surface would be in the top plane. The closest distance 47 between the top plane 45 and any portion of the internal thread 60 is 4.85 mm. The wall thickness 49 of the annular plug seal 76 is 1.19 mm.

Figure 11:
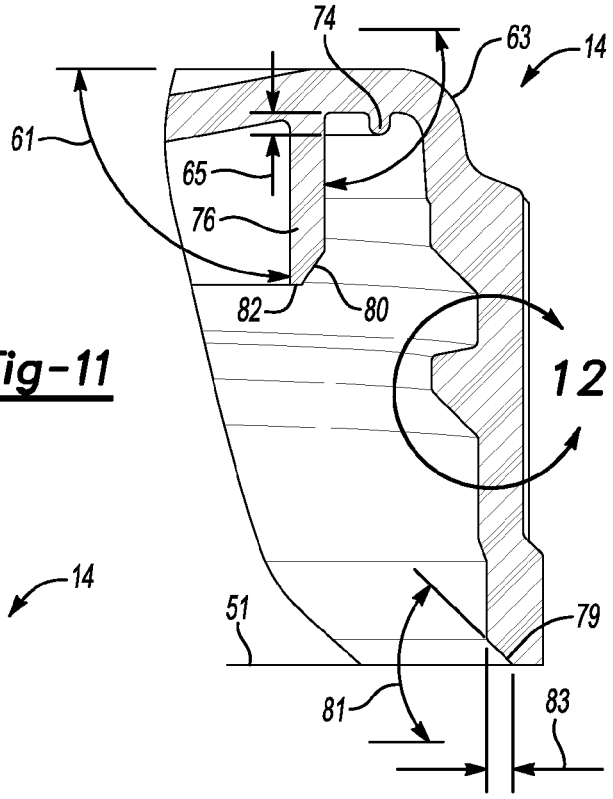
FIG. 11 is an enlarged side cross-sectional view of a portion of the closure cap depicted in FIG. 10.

FIG. 11 is an enlarged cross-sectional view of the closure cap 14 that shows more detail. The annular plug seal 76 has an internal draft angle 61 of 90.6 degrees and an external draft angle 63 of 90.5 degrees. The projection distance 65 of the raised annular cap bead 74 from the end wall is 0.74 mm. The closure cap 14 defines a bottom plane 51 at a greatest distance parallel to the center axis 32 from the end wall 50. To illustrate, if the closure cap 14 were to be placed with the flared portion 55 of the annular skirt 54 resting on a table surface (not shown), the table surface would be in the bottom plane 51. The internal chamfer 79 is depicted making an internal chamfer angle 81 of 44.5 degrees with the bottom plane 51 of the closure cap. The internal chamfer width 83 is 0.91 mm measured as a projection onto the bottom plane 51.

Figure 12:
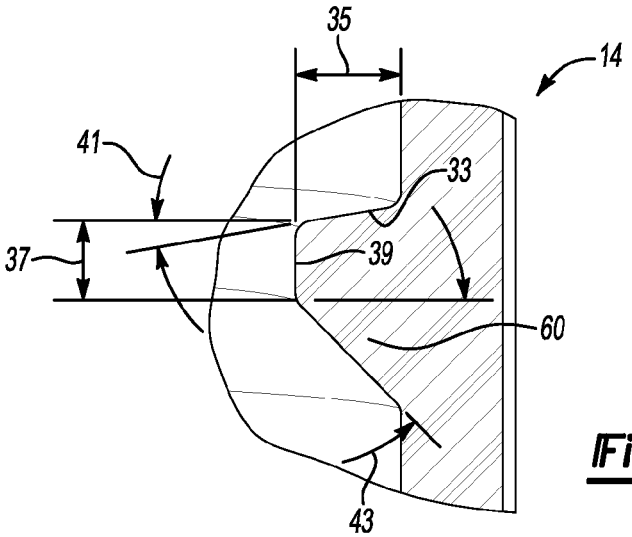
FIG. 12 is a further enlarged side cross-sectional view of a portion of the closure cap depicted in FIG. 11.

FIG. 12 depicts details of the thread profile of the internal thread. The thread pitch is 0.2 inch (5.08 mm). The leading flank angle 43 is 45 degrees. The trailing flank angle 41 is 10 degrees. As used herein, the leading flank means the flank of a thread that faces the mating thread when the thread is about to be assembled with the mating thread. The trailing flank is opposite to the leading flank. The internal thread crest 39 has an internal thread crest width 37 of 1.19 mm. The internal thread height 35 is 1.63 mm.

Figure 13:
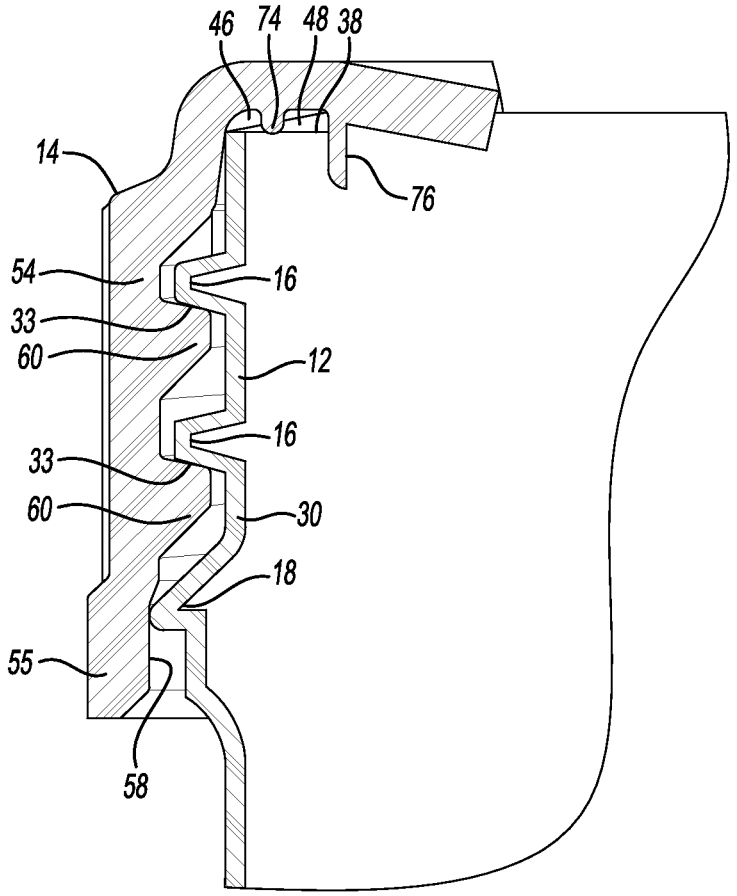
FIG. 13 is an enlarged side cross-sectional view of a portion of the resealable container and closure package depicting detail of the engagement of the closure cap and the container.

FIG. 13 is an enlarged side cross-sectional view of a portion of the resealable container and closure package 10, 10', 10" depicting detail of the engagement of the closure cap 14 and the container 11, 11', 11". The internal thread 60 engages the external thread 16 at the trailing flanks 33. The raised annular neck bead 18 contacts and supports the flared portion 55 of the annular skirt 54. The support of the flared portion 55 of the annular skirt 54 by the raised annular neck bead 18 helps resist distortion of the closure cap 14 during impact and contributes to the superior leak resistance of the present disclosure. The raised annular cap bead 74 deflects the resilient annular lip 38 slightly and sealingly engages the sealing surface 46 disposed on an exterior surface 48 of the resilient annular lip 38. The annular plug seal 76 sealingly engages the annular lip 38 and forms an interference fit with the annular lip 38.

Figure 14:
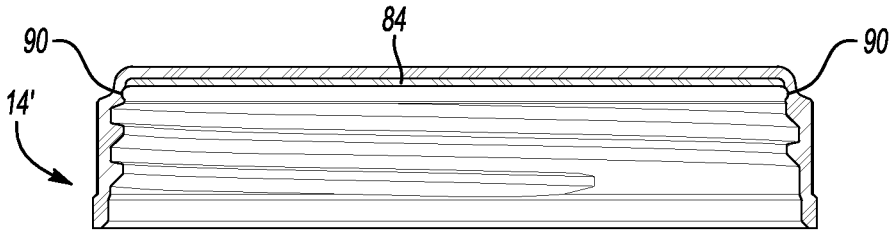
FIG. 14 is a cross-sectional side view of an example of a closure cap having a liner according to the present disclosure.

In the example of the present disclosure depicted in FIG. 14, the plug seal is not included in the closure cap 14'. The example depicted in FIG. 14 includes a liner disk 84 retained in contact with an interior surface 86 of the end wall 50 of the closure cap 14' to form a sealing gasket 88 between the closure cap 14' and the container when the closure cap 14' is installed on the container 11, 11', 11". A plurality of liner retention lugs 90 is defined on the inner surface 62 of the annular skirt 54 to retain the liner disk 84 when the closure cap 14' is separated from the container 11, 11', 11". The liner disk 84 may be attached to the inner surface 62 of the annular skirt 54 with an adhesive (not shown). The liner disk 84 may be a coated foam liner disk. In an example, the liner disk 84 may have a thickness of about 0.64 mm. In an example, liner disks 84 may be formed by coextruding a sheet of the liner material and cutting liner disks from the sheet.

In examples of the present disclosure, an internal volume 98 of the resealable container and closure package 10 with the closure cap 14, 14' installed on the container 11, is about one and one-half quart (1.42 liters). As used herein, the internal volume 98 of the resealable container and closure package 10, 10', 10" means the Bottle Capacity as determined by ASTM D2911-10 Standard specification for Dimensions and Tolerances for Plastic Bottles section 8.1 Bottle Capacity, or equivalent.

In other examples, the internal volume 98 of the resealable container and closure package 10' with the closure cap 14, 14' installed on the container 11' is about one quart (0.95 liters). In still other examples, the internal volume 98 of the resealable container and closure package 10" with the closure cap 14, 14' installed on the container 11" is about one-half gallon (1.89 liters).

With the closure cap 14, 14' installed on the container 11, 11', 11", the resealable container and closure package 10, 10', 10" is to have no visible leakage of water after a drop test from 12 feet elevation to impact the bottom of the container onto a smooth solid concrete floor.

In examples of the present disclosure, the closure cap 14, 14' is removable and reinstallable on the container 11, 11', 11" at least 3 times on a specimen of the resealable container and closure package 10, 10' 10" without any reduction in seal performance of the specimen between a drop test performed on the specimen after initially installing the closure cap 14, 14' on the container 11, 11', 11" and a subsequent drop test performed on the same specimen after the closure cap 14, 14' has been installed on the container the third time.

The closure cap 14, 14' is removable from the container 11, 11', 11" after an initial installation of the closure cap 14, 14' on the container 11, 11', 11" without overcoming a frangible connection between portions of the closure cap 14, 14'.

It is to be understood use of the words "a" and "an" and other singular referents may include plural as well, both in the specification and claims, unless the context clearly indicates otherwise.

It is to be understood that the ranges provided herein include the stated range and any value or sub-range within the stated range. For example, a range from about 0 degrees to about 5 degrees should be interpreted to include not only the explicitly recited limits of about 0 degrees to about 5 degrees, but also to include individual values, such as 1 degree, 1.2 degrees, 2.5 degrees, 4.0 degrees, etc., and sub-ranges, such as from about 1.5 degrees to about 4.5 degrees, from about 2.0 degrees to about 3.0 degrees, etc. Further, when "about" is utilized to describe a value, this is meant to encompass minor variations (up to +/−10%) from the stated value.

Furthermore, reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

While several examples have been described in detail, it will be apparent to those skilled in the art that the disclosed examples may be modified. Therefore, the foregoing description is to be considered non-limiting.

What is claimed is:

1. A resealable container and closure package, comprising:
- a container, including:
  - a longitudinal center axis; and
  - a finish portion formed on a neck of the container, the finish portion including:
    - a single start external helical thread formation established on the finish portion, the external thread formation including about one and one-half continuous thread turns of a complete thread profile, the complete thread profile having symmetrical external thread flank angles of about 13 degrees;
    - a resilient annular lip extending radially inwardly from an inner diameter of the neck at an angle from about 0 degrees to about 5 degrees from a plane orthogonal to the center axis; and
    - a sealing surface disposed on an exterior surface of the annular lip; and
- a closure cap, including:
  - an end wall defining a circumferential edge;
  - an annular skirt projecting from the end wall;
  - an internal thread defined on an inner surface of the annular skirt, wherein:
    - the internal thread is threadingly engageable with the external thread formation; and
    - the internal thread has an "M" style cross-section for an SP 400 Finish.

2. The resealable container and closure package as defined in claim 1, further comprising:
- a raised annular neck bead disposed on an outer surface of the neck distal to the annular lip;
- a frustoconical surface of the raised annular neck bead increases in diameter as a distance from the annular lip increases;
- a cylindrical surface of the raised annular neck bead is defined at a maximum diameter of the frustoconical surface; and
- an edge of the cylindrical surface distal to annular lip defines a finish bottom plane perpendicular to the longitudinal center axis.

3. The resealable container and closure package as defined in claim 1, further comprising a raised annular cap bead disposed on the closure cap to sealingly engage the sealing surface when the closure cap is installed on the container.

4. The resealable container and closure package as defined in claim 3, further comprising an annular plug seal extending substantially parallel to the center axis from the end wall, wherein:
- the annular plug seal has an unstressed plug seal outer diameter about 0.19 inch larger than the inner diameter of the neck;
- the annular plug seal has an outer filet or chamfer at a leading edge of the annular plug seal; and
- the annular plug seal is to sealingly engage the annular lip and form an interference fit with the annular lip when the closure cap is installed on the container.

5. The resealable container and closure package as defined in claim 1, further comprising:
- a liner disk retained in contact with an interior surface of the end wall of the closure cap to form a sealing gasket between the closure cap and the container when the closure cap is installed on the container; and
- a plurality of liner retention lugs defined on the inner surface of the annular skirt to retain the liner disk when the closure cap is separated from the container.

6. The resealable container and closure package as defined in claim 1, wherein:
- the external thread formation has a major diameter from 88.73 (mm) millimeters to 89.63 mm;
- the external thread formation has a minor diameter from 85.68 mm to 86.58 mm;
- the neck has a minimum internal diameter of 73.66 mm;
- a top edge of the annular lip distal to an enclosed volume of the resealable container and closure package, the top edge of the annular lip defining an inner lip diameter 7.62 mm smaller than the minor diameter;
- a shortest distance between the top edge of the annular lip and the external thread formation is from 3.23 mm to 3.99 mm;

a shortest distance between the top edge of the annular lip and the frustoconical surface of the raised annular neck bead measured at a bead surface diameter from 87.89 mm to 88.39 mm is from 15.06 mm to 15.82 mm;

a maximum diameter of the frustoconical surface is from 89.92 mm to 90.42 mm; and a perpendicular distance between the top edge of the annular lip and the finish bottom plane is from 16.32 mm to 17.08 mm.

7. The resealable container and closure package as defined in claim 1 wherein the resealable container and closure package with the closure cap installed on the container has an internal volume of about one-half gallon (1.89 liters).

8. The resealable container and closure package as defined in claim 1 wherein the resealable container and closure package with the closure cap installed on the container has an internal volume of about one quart (0.95 liters).

9. The resealable container and closure package as defined in claim 1 wherein the resealable container and closure package with the closure cap installed on the container has an internal volume of about one and one-half quart (1.42 liters).

10. The resealable container and closure package as defined in claim 1 wherein the resealable container and closure package with the closure cap installed on the container is to have no visible leakage of water after a drop test from 12 feet elevation to impact the bottom of the container onto a solid concrete floor.

11. The resealable container and closure package as defined in claim 10 wherein the closure cap is removable and reinstallable on the container at least 3 times on a specimen of the resealable container and closure package without a reduction in seal performance of the specimen between a drop test performed on the specimen after initially installing the closure cap on the container and a subsequent drop test performed on the same specimen after the closure cap has been installed on the container the third time.

12. The resealable container and closure package as defined in claim 10 wherein the closure cap is removable from the container after an initial installation of the closure cap on the container without overcoming a frangible connection between portions of the closure cap.

* * * * *